United States Patent [19]

Miyamura et al.

[11] Patent Number: 4,727,832

[45] Date of Patent: Mar. 1, 1988

[54] ROLLER ROCKER ARM

[75] Inventors: Noriyuki Miyamura; Shuji Nagano, both of Kyoto, Japan

[73] Assignee: Mitsubishi Jidosha Kogyo Kabushiki Kaisha, Japan

[21] Appl. No.: 61,693

[22] Filed: Jun. 12, 1987

[30] Foreign Application Priority Data

| | | | |
|---|---|---|---|
| Jun. 13, 1986 | [JP] | Japan | 61-137733 |
| Jun. 13, 1986 | [JP] | Japan | 61-90419 |
| Jun. 13, 1986 | [JP] | Japan | 61-90420 |
| Jun. 13, 1986 | [JP] | Japan | 61-90421 |
| Jun. 13, 1986 | [JP] | Japan | 61-90423 |

[51] Int. Cl.[4] ..... F01L 1/18

[52] U.S. Cl. ..... 123/90.44; 123/90.5; 123/90.39

[58] Field of Search ..... 123/90.5, 90.44, 90.39, 123/90.41, 90.27

[56] References Cited

U.S. PATENT DOCUMENTS

| | | | |
|---|---|---|---|
| 2,014,036 | 9/1935 | Brush | 123/90.44 |
| 2,935,878 | 5/1960 | Wirsching | 123/90.5 |
| 3,466,073 | 9/1969 | Pohle | 123/90.39 |
| 4,182,290 | 1/1980 | Pohle | 123/90.39 |
| 4,628,874 | 12/1986 | Barlow | 123/90.5 |
| 4,674,453 | 6/1987 | Dove, Jr. | 123/90.39 |
| 4,682,575 | 7/1987 | Simko | 123/90.39 |

FOREIGN PATENT DOCUMENTS

| | | | |
|---|---|---|---|
| 112320 | 9/1978 | Japan | 123/90.44 |
| 54616 | 4/1980 | Japan | 123/90.44 |

*Primary Examiner*—Ira S. Lazarus

*Attorney, Agent, or Firm*—Oldham, Oldham & Weber Co.

[57] ABSTRACT

Disclosed herein is a roller rocker arm comprising a rocker arm body having a rocking center hole through which a rocker shaft is inserted and adapted to be rockably supported to the rocker shaft; a pair of forked projections projecting from the rocker arm body in a direction perpendicular to a tangent of a circle about a rocking center axis of the rocker arm body; a pair of pin holes formed through the pair of forked projections; a hollow roller pin inserted into the pair of pin holes and fixed between the pair of forked projections; a cam follower roller through which the roller pin is inserted; a plurality of needle rollers interposed between the cam follower roller and the roller pin for rotatably supporting the cam follower roller to the roller pin in such a manner as to extend in parallel one another in a longitudinal direction of the roller pin; a pair of disk-like spacers rotatably supported to the roller pin and interposed between ends of the needle rollers and the projections; and an adjuster mounted in the rocker arm body and adapted to abut against a valve.

11 Claims, 11 Drawing Figures

ROLLER ROCKER ARM

BACKGROUND OF THE INVENTION

The present invention relates to a rocker arm for use with a valve operating mechanism for an engine, and more particularly to a roller rocker arm using a roller at a contact portion to a cam.

FIG. 1 shows a conventional roller rocker arm as disclosed in Japanese Utility Model Laid-open No. 57-85653. Referring to FIG. 1, a body 05 of the roller rocker arm has two walls portions between which a space is defined. There is provided in the space a cylindrical outer ring 01 rotatably supported to the body 05 by using a bolt 07, a nut 071, an inner ring 031, and needle rollers 02.

The inner ring 031 is substantially cylindrical, and is held between both the wall portions of the body 05 by tightening the nut 071 to the bolt 07 passing through both the wall portions and an axial hole 036 of the inner ring 031. The inner ring 031 has an outer peripheral surface including small-diameter shoulder surfaces 035 formed at both longitudinal ends thereof and adapted to be engaged with doughnut-shaped collar rings 04 and a large-diameter raceway surface 034 formed between both the shoulder surfaces 035 and adapted to contact the needle rollers 02.

The outer ring 01 is formed with a small-diameter inner peripheral raceway surface 012 at a portion opposed to the outer raceway surface 034 of the inner ring 031, that is, at the portion on which the needle rollers 02 are rolled, and is further formed at its both ends with large-diameter shoulder surfaces 011 contacting outer peripheral surfaces 042 of the collar rings 04. Further, an outer peripheral surface 014 of the outer ring 01 contacts a cam plate 06.

In the above-mentioned arrangement, as the inner ring 031 is fixed to the body 05 by means of the bolt 07 and the nut 071, a weight of the bolt and the nut causes an increase in a whole weight of the rocker arm.

Furthermore, as the bolt 07 and the nut 071 project outwardly of the body 05, it is necessary to arrange adjacent parts so as to avoid the interference of the bolt 07 and the nut 071 in the case that the body 05 is displaced in association with the operation of the cam plate 06. Accordingly, the device is disadvantageously enlarged in size.

Additionally, the collar rings 04 are axially positioned by the shoulder portions of the inner ring 031, that is, they are designed not to rotate in association with the rolling operation of the needle rollers 02. Accordingly, in the event that an axial thrust load is applied to the needle rollers 02, there easily occurs seizure between the needle rollers 02 and the collar rings 04.

SUMMARY OF THE INVENTION

It is an object of the present invention to provide a roller rocker arm which may eliminate the necessity of any parts for fixing a roller pin to a rocker arm body, thereby reducing the weight.

It is another object of the present invention to provide a roller rocker arm which may be made compact.

It is a further object of the present invention to provide a roller rocker arm which may suppress the seizure between needle bearings and spacers in the event that an axial thrust load is applied to the needle bearings.

According to the present invention, there is provided a roller rocker arm comprising a rocker arm body having a rocking center hole through which a rocker shaft is inserted and adapted to be rockably supported to the rocker shaft; a pair of forked projections projecting from the rocker arm body in a direction perpendicular to a tangent of a circle about a rocking center axis of the rocker arm body; a pair of pin holes formed through the pair of forked projections; a hollow roller pin inserted into the pair of pin holes and fixed between the pair of forked projections; a cam follower roller through which the roller pin is inserted; a plurality of needle rollers interposed between the cam follower roller and the roller pin for rotatably supporting the cam follower roller to the roller pin in such a manner as to extend in parallel one another in a longitudinal direction of the roller pin; a pair of disk-like spacers rotatably supported to the roller pin and interposed between ends of the needle rollers and the projections; and an adjuster mounted in the rocker arm body and adapted to abut against a valve.

Other objects and features of the invention will be more fully understood from the following detailed description and appended claims when taken with the accompanying drawings.

DETAILED DESCRIPTION OF THE PREFERRED EMBODIMENTS

Figure 1:
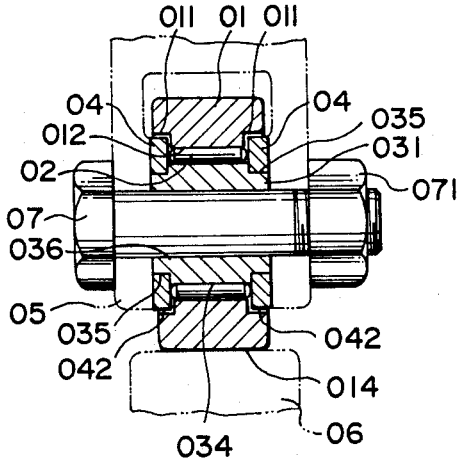
FIG. 1 PRIOR ART
FIG. 1 is a sectional view of the essential part in the prior art.
Figure 2:
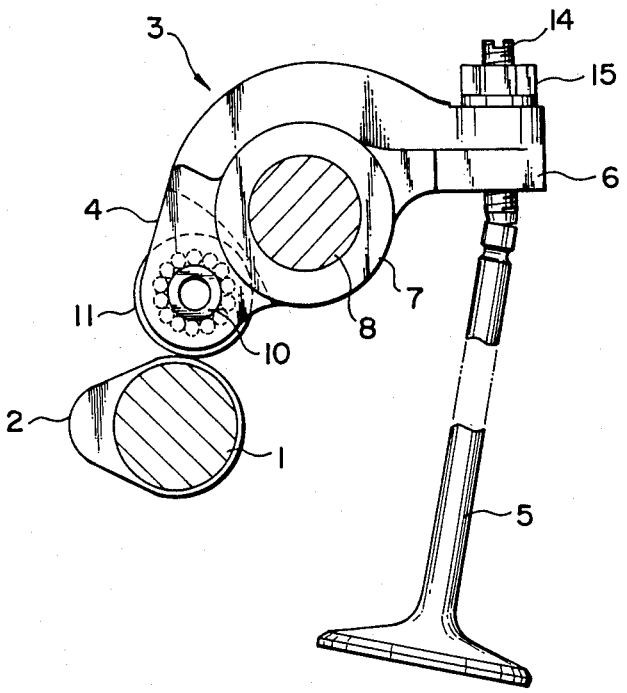
FIG. 2 is a schematic side view of a valve operating mechanism of a first preferred embodiment according to the present invention.
Figure 3:
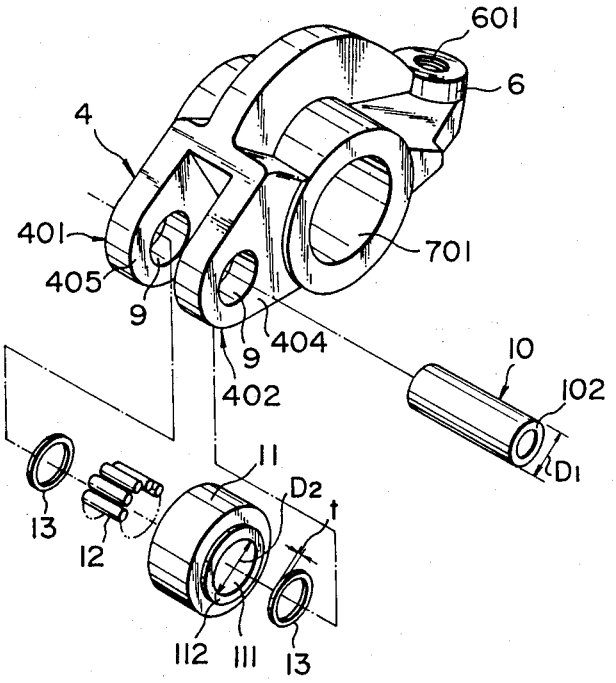
FIG. 3 is an exploded perspective view of a roller rocker arm shown in FIG. 2.
Figure 4:
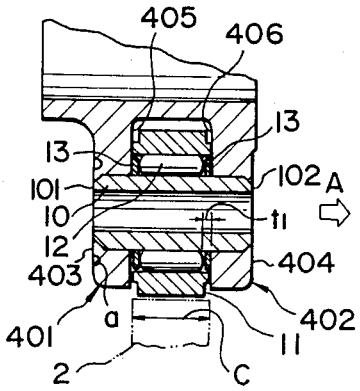
FIG. 4 is a sectional view of the essential part of the roller rocker arm shown in FIG. 3.

Referring now to FIGS. 2 to 4 which show a first preferred embodiment of the present invention, reference numeral 1 designates a cam shaft for an engine, which can shaft 1 has a cam 2. Reference numeral 3 designates a rocker arm body formed at its one end with a cam opposed end 4 opposed to the cam 2 and formed at the other end with a valve opposed end 6 opposed to a valve 5 for opening and closing a combustion chamber (not shown). A rocker shaft 8 is inserted into a rocking center hole 701 of a boss 7 formed at the central portion of the rocker arm body 3, and is supported in parallel relationship to the cam shaft 1. Thus, the rocker arm body 3 is rockably supported to the rocker shaft 8. The rocker arm body 3 is formed of an aluminum alloy, and it is integrally produced by aluminum die casting.

The cam opposed end 4 is formed with a pair of forked projections 401 and 402 to define a space therebetween. Both the projections 401 and 402 are formed with pin holes 9 for inserting a roller pin 10 thereinto. The roller pin 10 is arranged in parallel relationship to the cam shaft 1 and the rocker shaft 8. There is provided in the space between the projections 401 and 402 a cam follower roller 11 (which will be hereinafter simply referred to as a roller 11) rotatably supported to the roller pin 10 and adapted to contact the cam 2.

The roller pin 10 is of a hollow cylindrical shape, and it is formed of steel treated by quenching over the entire length thereof. Further, the roller pin 10 is chamfered at its both end surfaces 101 and 102 to form tapering portions.

Each of the pin holes 9 has an inner diameter slightly smaller than an outer diameter $D_1$ of the roller pin 10. Thus, the roller pin 10 is press fitted into the pin holes 9 until the end surfaces 101 and 102 of the roller pin 10 come into a flush relationship with outer side surfaces 403 and 404 of the projections 401 and 402, respectively. Then, the outer side surface 403 of the projection 401 engaging with the end surface 101 at a trailing end of a press fit direction (as shown by an arrow A in FIG. 4) of the roller pin 10 is deformed by caulking at the periphery of the end surface 101 as shown by a reference symbol a. Accordingly, as the end surface 102 at a leading end of the press fit direction of the roller pin 10 is press fitted to enlarge the pin hole 9, it is prevented from being moved in the press fit direction as far as an external force equal to a press fitting force is not applied to the roller pin. Further, the movement of the roller pin in the direction reversed to the press fit direction is restricted by the caulking.

A plurality of needle roller bearings 12 are arranged on the outer peripheral surface of the roller pin 10 and extend in the longitudinal direction at a central portion of the roller pin 10. Further, a pair of washer-like spacers 13 formed of steel are loosely fitted between the ends of the needle bearings 12 and inner side surfaces 405 and 406 of the projections 401 and 402 in such a manner as to be rotatably supported to the roller pin 10. The roller 11 is mounted on the roller pin 10 with the needle bearings 12 interposed therebetween.

Each of the spacers 13 is a disk-like member having an outer diameter smaller than an inner diameter $D_2$ of the roller 11 and having an inner diameter greater than the outer diameter $D_1$ of the roller pin 10. Further, each spacer 13 has a thickness t smaller than a gap $t_1$ defined between the ends of the needle bearings 12 and the inner side surfaces 405 and 406 of the projections 401 and 402 in a fixed position (as shown in FIG. 4). The spacers 13 are formed of a material having a wear resistance to the needle bearings 12, such as phosphor bronze. Alternatively, the outer diameter of the each spacer 13 may be set to be greater than the inner diameter $D_2$ of the roller 11, and it may be designed to come into sliding contact with bosses 112 of the roller 11 as well as the ends of the needle bearings 12.

The valve opposed end 6 includes a female thread portion 601 threadedly engaged with a bolt-like adjuster 14. A nut 15 for fixing the adjuster 14 is threadedly engaged with the adjuster 14 which is threadedly engaged with the female portion 601. The lower end of the adjuster 14 abuts against the upper end of the valve 5. The bolt-like adjuster 14 may be substituted by an auto lash adjuster.

The roller 11 is formed of steel or ceramics, and it is of a substantially cylindrical shape having a rotative center hole 111 therein. The roller 11 is formed with bosses 112 and its axial both ends along the outer circumference of the rotative center hole 111. The roller 11 has a width substantially equal to a width C of the cam 2, excepting the bosses 112.

With this arrangement as mentioned above, since the roller 11 contacts the cam 2 under a predetermined pressure, it is rotated about the roller pin 10 in association with the rotation of the cam 2. The rocker arm body 3 is rocked about the rocker shaft 8 according to the displacement of the roller 11, thereby downwardly displacing the valve 5 through the adjuster 14 mounted in the valve opposed end 6.

Accordingly, as the transmission of a driving force between the cam 2 and the rocker arm body 3 is carried out through the needle bearings 12 and the roller 11, a friction loss of the driving force may be reduced.

Furthermore, as the roller pin 10 rotatably supporting the roller 11 is hollow, and it is fixed by press fitting and caulking to the rocker arm body 3 without the necessity of any additional fixing parts, the roller rocker arm may be reduced in weight.

Since both the end surfaces 101 and 102 of the roller pin 10 are not projected outwardly from the rocker arm body 3, the roller rocker arm may be made compact in the longitudinal direction of the rocker shaft 8.

The rocker arm body 3 is formed of an aluminum alloy, thereby making the rocker arm lightweight. Further, as the spacers 13 are interposed between the needle bearings 12 and the rocker arm body 3, the rocker arm body 3 may be prevented from being damaged by the needle bearings 12, thereby improving the durability of the roller rocker arm.

Since the spacers 13 are rotatably mounted, they are rotated with the needle bearings 12 rotating about the roller pin 10 in the event that an axial thrust load is applied to the needle bearings 12, thereby suppressing seizure between the needle bearings 12 and the spacers 13.

As is mentioned above, the rocker arm body 3 is formed of an aluminum alloy which is softer than the roller pin 10. Therefore, upon press fitting the roller pin 10, the surface of the roller pin 10 may be prevented from being damaged.

The roller pin 10 is fixed by caulking at the periphery of the end surface 101 the roller pin 10 after the roller pin 10 is press fitted into the pin holes. Therefore, only one caulking step is necessary, and the number of steps in producing the roller rocker arm may be reduced.

The spacers 13 are received in the gaps opposite to the bosses 112 of the roller 11, and the width of the needle bearings 12 is rendered corresponding to the width C of the cam 2. Accordingly, a pushing force of the cam 2 applied to a unit length of the needle bearings 12 may be reduced, thereby improving the durability.

There will be now described a second preferred embodiment wherein a surface hardened layer is formed on the rocker arm body 3. The inner side surfaces 405 and 406 of the projections 401 and 402 of the rocker arm body 3 are treated at a portion opposed to the roller 11 by a lubricating alumite. This treatment is conducted in accordance with the following process. In a mixed acid aq. solution of sulfuric acid and oxalic acid, the portion to be treated is electrolytically treated by a D.C. power to form a porous anodic oxide film and thereafter wash same with water. Then, the anodic oxide film is immersed in an aq. solution of nitric acid to activate same, and thereafter it is washed with water. Then, in an aq. solution of ammonium thiomolybdate at a temperature of 15°-20° C., electrolysis is carried out by a D.C. power with the anodic oxide film being set as an anode and with a carbon rod being set as a cathode. Thereafter, the anodic oxide film is washed with water, and is then immersed in a hot water of 40° C. As a result, a thin film of thermoplastic resin is softened, and it is peeled off by an operator. Thus, a sulfide of molybdenum is formed in the pores of the anodic oxide film.

According to the second preferred embodiment, it is possible to obtain an effect substantially the same as that of the first preferred embodiment, and additionally the rocker arm body 3 may be sufficiently prevented from being damaged even upon rotating the roller 11.

Although the above-mentioned treatment is applied to the entire surface of the inner side surfaces 405 and 406, it may be applied to only a part of the inner side surfaces 405 and 406 as opposed to the bosses 112 of the roller 11 or opposed to the spacers 13. In this case, the same effect may be obtained.

The above-mentioned lubricating alumite treatment may be also applied to the inner peripheral surface of the pin holes 9 of the rocker arm body 3. In this case, it is possible to prevent any damage on the inner peripheral surface upon press fitting the roller pin 10.

There will be now described the other modified embodiments with reference to FIGS. 5 to 11, in which substantially the same components or parts as of the first preferred embodiment are designated by the same reference numerals with the explanation therefor omitted.

Figure 5:
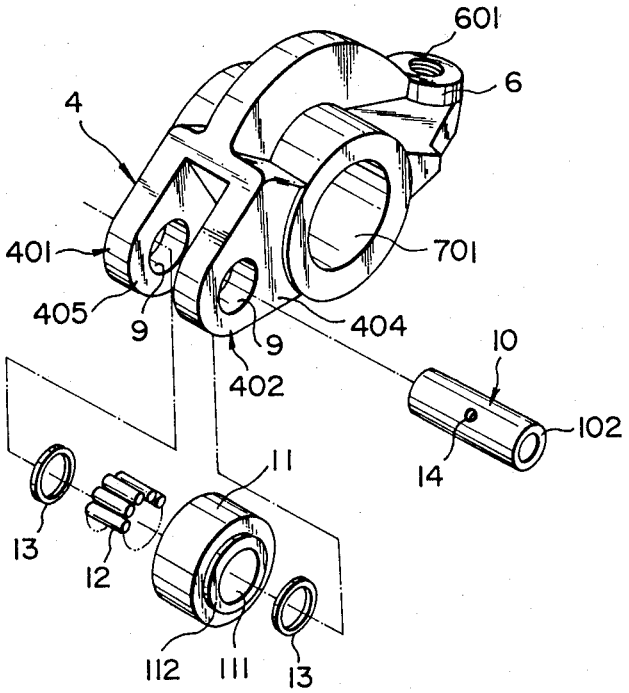
FIG. 5 is an exploded perspective view of a roller roller arm of a third preferred embodiment according to the present invention.
Figure 6:
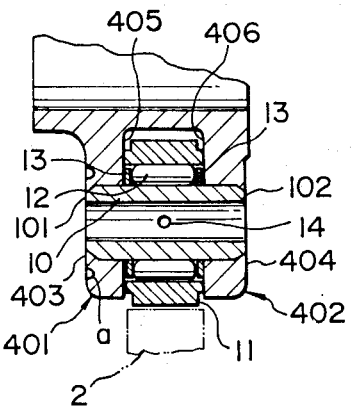
FIG. 6 is a sectional view of the essential part of the roller rocker arm shown in FIG. 5.

Referring to FIGS. 5 and 6 which show a third preferred embodiment of the present invention, the roller pin 10 is formed at its central portion with an oil supply hole 14. With this arrangement, an oil supplied into the cylindrical roller pin 10 is supplied through the oil supply hole 14 to the needle bearings 12 mounted on the outer periphery of the roller pin 10. According to this embodiment, it is possible to obtain an effect substantially the same as of the first preferred embodiment, and additionally a rolling resistance between the roller 11 and the needle bearings 12 may be reduced. Accordingly, the friction loss of the driving force to be transmitted from the cam 2 may be further reduced.

Figure 7:
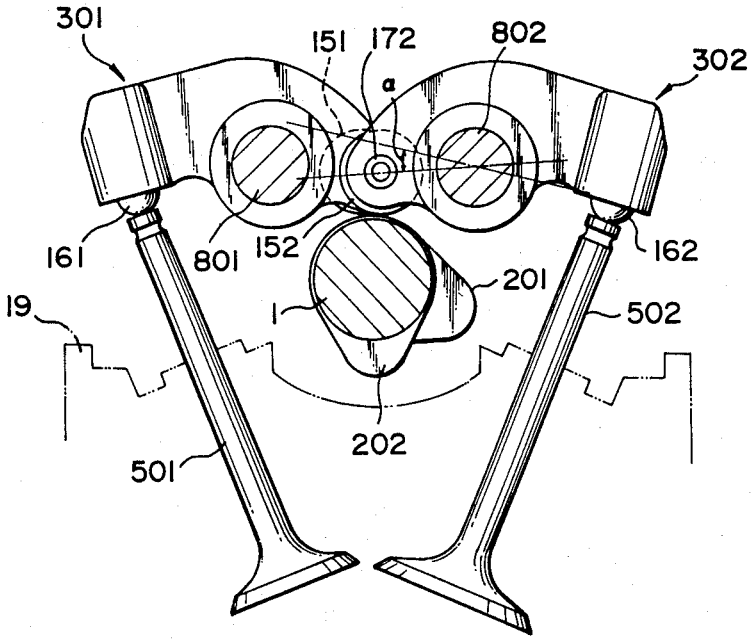
FIG. 7 is a schematic side view of a valve operating mechanism of a fourth preferred embodiment according to the present invention.
Figure 8:
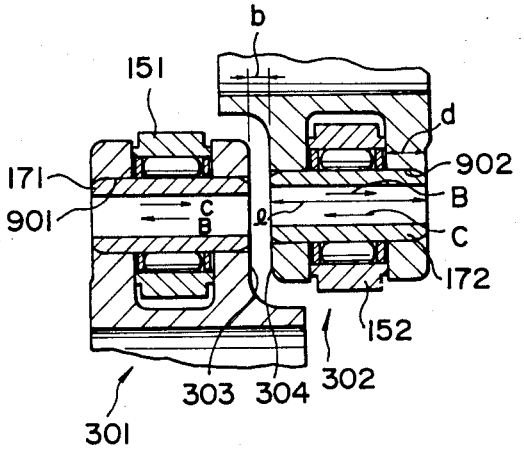
FIG. 8 is a sectional view of the essential part of a roller rocker arm shown in FIG. 7.

Referring next to FIGS. 7 to 10 which show a fourth preferred embodiment, an intake valve and an exhaust valve are provided for each cylinder in an actual engine. As shown in FIG. 7, an intake valve 501 and an exhaust valve 502 are arranged in symmetrical relationship with each other with respect to the cam shaft 1 in the axial direction of the rocker shaft of the rocker arm. Cams 201 and 202 are supported to the cam shaft 1. The displacement due to the rotation of these cams 201 and 202 is transmitted to rollers 151 and 152 and rocker arm bodies 301 and 302 rockably supported to rocker shafts 801 and 802, and it is then transmitted to adjusters 161 and 162, thereby opening and closing the intake valve 501 and the exhaust valve 502.

Figure 9:
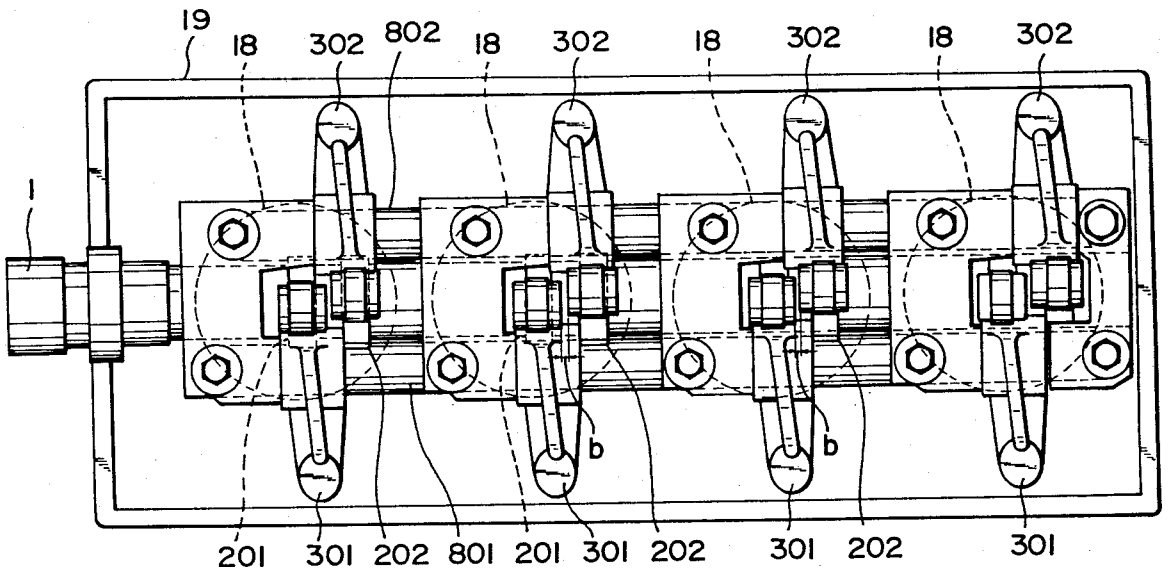
FIG. 9 is a schematic plan view of FIG. 7.

In the rocker arm bodies 301 and 302, an inner diameter of pin holes 901 and 902 for inserting roller pins 171 and 172 therein is set to be smaller than an outer diameter of the roller pins 171 and 172. A clearance b between opposed outer side surfaces 303 and 304 of the rocker arm bodies 301 and 302 is set to be less than half a length l of the roller pin 171 or 172. The clearance b is preferably less than a thickness d of the projections of the rocker arm bodies 301 and 302. In assembling, the roller pins 171 and 172 are press fitted into the pin holes from the outer side surfaces 303 and 304 sides (in a direction as depicted by an arrow B in FIG. 8) before the rocker arm bodies 301 and 302 are assembled with the rocker shafts 801 and 802. Accordingly, after assembling the roller rocker arm to make same ready for driving, the rocker arms are rocked at a predetermined rocking angle $\alpha$, and the roller pins 171 and 172 are therefore opposite to the outer side surfaces 304 and 303. FIG. 9 shows the arrangement of the roller rocker arms as arranged for each cylinder 18. Reference numeral 19 denotes a cylinder head.

According to the above-mentioned preferred embodiment, it is possible to obtain an effect substantially the same as of the first preferred embodiment. Additionally, in the event that the roller pins 171 and 172 continue to be slipped gradually in a direction of C which is reversed to the press fit direction B because of vibration in association with the rocking motion of the rocker arm, it is possible to hinder projection of the roller pins 171 and 172 greater than the clearance b by the opposed roller pins 172 and 171 or the outer side surfaces 303 and 304, thereby preventing the roller pins 171 and 172 and the rollers 151 and 152, etc. from being disengaged from the rocker arm bodies 301 and 302.

Figure 10:
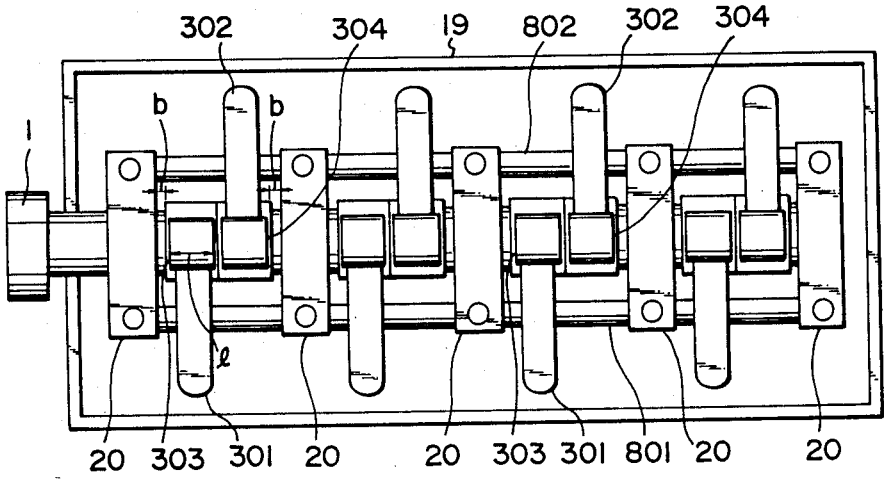
FIG. 10 is a schematic plan view of a modification of the fourth preferred embodiment.

Although such disengagement of the roller pins 171 and 172 is prevented by the opposed rocker arms in the above-mentioned embodiment, a modified structure as shown in FIG. 10 may be employed. Referring to FIG. 10, the cam shaft 1 and the rocker shafts 801 and 802 are rotatably supported by a plurality of bearing members 20 fixed at an upper portion of the cylinder head 19. The outer side surfaces 303 and 304 of the rocker arm bodies 301 and 302 from which surfaces the roller pins 171 and 172 are press fitted are spaced a clearance b from side surfaces of the bearing members 20.

According to this embodiment, even when the roller pins 171 and 172 continue to be gradually slipped toward the bearing members 20 because of the vibration in association with the rocking motion of the rocker arm, it is possible to hinder projection of the roller pins 171 and 172 greater than the clearance b by the side surfaces of the bearing members 20, thereby preventing the roller pins 171 and 172, etc. from being disengaged from the rocker arm bodies 301 and 302.

Figure 11:
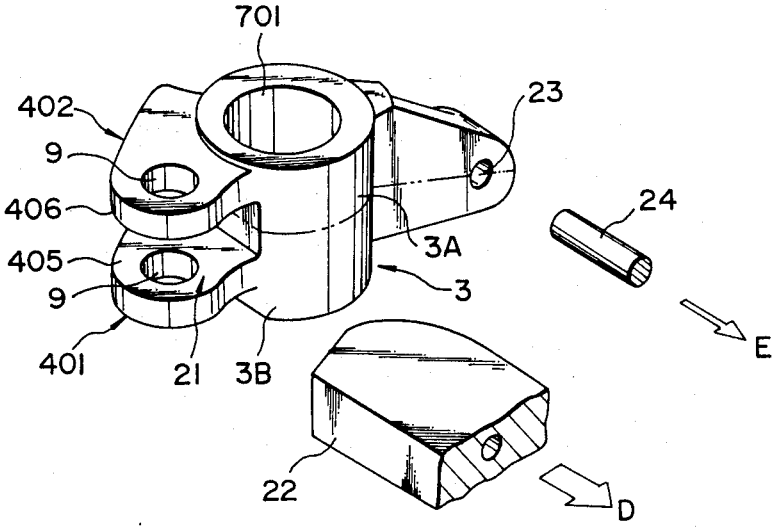
FIG. 11 is an illustration showing a producing method of the rocker arm body.

Referring next to FIG. 11 which illustrates a producing method of the rocker arm body 3, the rocker arm body 3 is formed by filling a molten metal of aluminum alloy under pressure into a space defined by four molds to be hereinafter described. A first mold (not shown) for forming a part 3A including a projection 402 and a second mold (not shown) for forming a part 3B including a projection 401 are divided along a plane which is perpendicular to a rocking center axis (a center axis of a rocking center hole 701) and passes through a space 21 defined between the projections 401 and 402 (which plane is shown by a dashed line in FIG. 11). Reference numerals 22 and 24 designate a third mold for forming the space 21 and a fourth mold for forming an adjuster engaging hole 23, respectively.

While the first and second molds are well known, and are not shown, they are, of course, provided with projections for defining the rocking center hole 701 and the pin holes 9. Either of the first or second mold, e.g., the first mold is movable away from the second mold. Further, the third and fourth molds 22 and 24 are movable molds, and after forming the rocker arm body 3, they are drawn in the directions of arrows D and E, respectively. The directions of D and E are parallel to each other on the plane perpendicular to the rocking center axis of the rocker arm body 3. In other words, the third and fourth molds 22 and 24 are adapted to be moved in the same direction.

The above-mentioned molds are combined to define a space corresponding to the rocker arm body 3, and a molten metal of aluminum alloy is filled into the space under pressure. Then, the first mold is separated from the second mold along the rocking center axis of the rocker arm, while the third and fourth molds 22 and 24 are drawn in the same directions of the arrows D and E, respectively. That is, it is merely necessary to move the movable molds in the two directions upon ejecting the mold product.

In the rocker arm body 3 ejected as mentioned above, the inner side surfaces 405 and 406 of the projections 401 and 402 are machined, preferably ground, and the adjuster engaging hole 23 is worked into the female thread portion 601 by means of a thread cutter. Further, the rocking center hole 701 and the pin holes 9 may be also machined.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A roller rocker arm comprising a rocker arm body having a rocking center hole through which a rocker shaft is inserted and a pair of forked projections, and adapted to be rockably supported to said rocker shaft; a hollow roller pin inserted into a pair of pin holes formed through said pair of forked projections, and fixed between said pair of forked projections in a direction perpendicular to a tangent of a circle about a rocking center axis of said rocker arm body; a cam follower roller through which said roller pin is inserted; a plurality of needle rollers interposed between said cam follower roller and said roller pin for rotatably supporting said cam follower roller to said roller pin in such a manner as to extend in parallel one another in a longitudinal direction of said roller pin; a pair of disk-like spacers rotatably supported to said roller pin and interposed between ends of said needle rollers and said projections; and an adjuster mounted in said rocker arm body and adapted to abut against a valve.

2. The roller rocker arm as defined in claim 1, wherein said rocker arm body is formed of aluminum alloy.

3. The roller rocker arm as defined in claim 1, wherein said projections of said rocker arm body has a surface hardened layer.

4. The roller rocker arm as defined in claim 2, wherein said projections of said rocker arm body has a surface hardened layer formed by a lubricating alumite treatment.

5. The roller rocker arm as defined in claim 4, wherein said surface hardened layer is formed at a portion of said projections opposed to both side surfaces of said cam follower roller.

6. The roller rocker arm as defined in claim 4, wherein said surface hardened layer is formed at a portion of said projections opposed to said spacers.

7. The roller rocker arm as defined in claim 1, wherein said roller pin is formed of steel.

8. The roller rocker arm as defined in claim 7, wherein said roller pin is quenched over the entire length thereof.

9. The roller rocker arm as defined in claim 1, wherein said roller pin is cylindrical.

10. The roller rocker arm as defined in claim 9, wherein said roller pin has an oil supply through-hole at a position opposed to said needle rollers.

11. The roller rocker arm as defined in claim 1, wherein each of said pin holes has an inner diameter smaller than an outer diameter of said roller pin.

* * * * *